US006251001B1

(12) United States Patent
Pinson et al.

(10) Patent No.: US 6,251,001 B1
(45) Date of Patent: Jun. 26, 2001

(54) SUBSTRATE POLISHING WITH REDUCED CONTAMINATION

(75) Inventors: Jay D. Pinson, San Jose; Brian J. Brown, Palo Alto; Thomas H. Osterheld, Mountain View; Benjamin A. Bonner, San Mateo; Doyle E. Bennett, Santa Clara; Nitin Shah, Fremont; Paul Flores, Morgan Hill, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/307,674

(22) Filed: May 10, 1999

(51) Int. Cl.[7] ..... B24B 55/02
(52) U.S. Cl. ..... 451/449; 450/53; 450/56
(58) Field of Search ..... 451/53, 56, 283, 451/287, 288, 289, 290, 444, 449, 450

(56) References Cited

U.S. PATENT DOCUMENTS

| | | | | |
|---|---|---|---|---|
| 5,195,922 | | 3/1993 | Genco | 454/57 |
| 5,401,212 | | 3/1995 | Marvell et al. | 454/187 |
| 5,431,599 | | 7/1995 | Genco | 454/187 |
| 5,595,522 | * | 1/1997 | Simpson et al. | 451/5 |
| 5,779,520 | * | 7/1998 | Hayakawa | 451/41 |
| 5,797,789 | * | 8/1998 | tanaka et al. | 451/5 |
| 6,053,801 | * | 4/2000 | Pinson et al. | 451/56 |

* cited by examiner

*Primary Examiner*—M. Rachuba
(74) *Attorney, Agent, or Firm*—Fish & Richardson

(57) ABSTRACT

Systems and methods for polishing a substrate with reduced contamination are described. Moist air is directed to one or more surfaces in proximity to the polishing surface and exposed to airborne slurry particles generated during polishing. By maintaining the atmosphere in the vicinity of the exposed surfaces at an elevated relative humidity level, airborne slurry particles adhering to the exposed surfaces remain in suspension and, therefore, may be easily cleaned, e.g., during a high pressure rinse cycle. This feature reduces the likelihood that slurry particles will accumulate on exposed surfaces of the polishing apparatus and flake off while a substrate is being polished, reducing the likelihood of substrate defects caused by such slurry contamination.

12 Claims, 4 Drawing Sheets

SUBSTRATE POLISHING WITH REDUCED CONTAMINATION

BACKGROUND OF THE INVENTION

The invention relates to substrate polishing techniques, including chemical mechanical polishing (CMP).

Chemical mechanical polishing is a process by which a substrate surface is smoothed (planarized) to a uniform level by a polishing pad and an abrasive slurry. A substrate to be polished is usually mounted on a rotatable carrier head and pressed against a moving polishing pad. The polishing pad typically consists of an abrasive sheet. An abrasive chemical solution (slurry) may be introduced onto the polishing pad to assist in the polishing process. Typically, a rinse arm supplies de-ionized water or other rinse fluid to the polishing pad to remove coagulated slurry and other material from the polishing pad surface.

SUMMARY OF THE INVENTION

In one aspect, the invention features systems and methods for polishing a substrate with reduced contamination. A substrate polishing system comprises: a substrate polishing apparatus including a substrate carrier, a polishing surface, and a slurry dispenser; and a humidifier configured to direct moist air to one or more surfaces in proximity to the polishing surface and exposed to airborne slurry particles generated during polishing. A method of polishing a substrate with a substrate polishing system comprises: supporting a substrate above a polishing surface; dispensing slurry onto the polishing surface; polishing the substrate against the polishing surface; and directing moist air to one or more surfaces of the substrate polishing system in proximity to the polishing surface and exposed to airborne slurry particles generated during polishing.

Embodiments may include one or more of the following features.

The humidifier may be configured to direct moist air in the vicinity of the substrate carrier. In one embodiment, the humidifier comprises a liquid atomizer. In another embodiment, the humidifier comprises a nozzle. In accordance with this embodiment, the humidifier is configured to receive a liquid and a gas, to mix received liquid and gas, and direct the mixed liquid and gas through the nozzle to generate a fine mist in the vicinity of the one or more exposed surfaces.

In operation, the humidifier may be configured to maintain the atmosphere in the vicinity of the one or more exposed surfaces at a relative humidity level of about 80% or greater. In one mode of operation, the humidifier may be configured to maintain a layer of liquid on the one or more exposed surfaces.

A humidistat may be coupled to the humidifier to control the humidity in the vicinity of the exposed surfaces.

Among the advantages of the invention are the following. By maintaining the atmosphere in the vicinity of the exposed surfaces at an elevated relative humidity level, airborne slurry particles adhering to the exposed surfaces remain in suspension and, therefore, may be easily cleaned, e.g., during a high pressure rinse cycle. This feature reduces the likelihood that slurry particles will accumulate on exposed surfaces of the polishing apparatus and flake off while a substrate is being polished, reducing the likelihood of substrate defects caused by such slurry contamination.

Other features and advantages will become apparent from the following description, including the drawings and the claims.

DETAILED DESCRIPTION

Figure 1A:
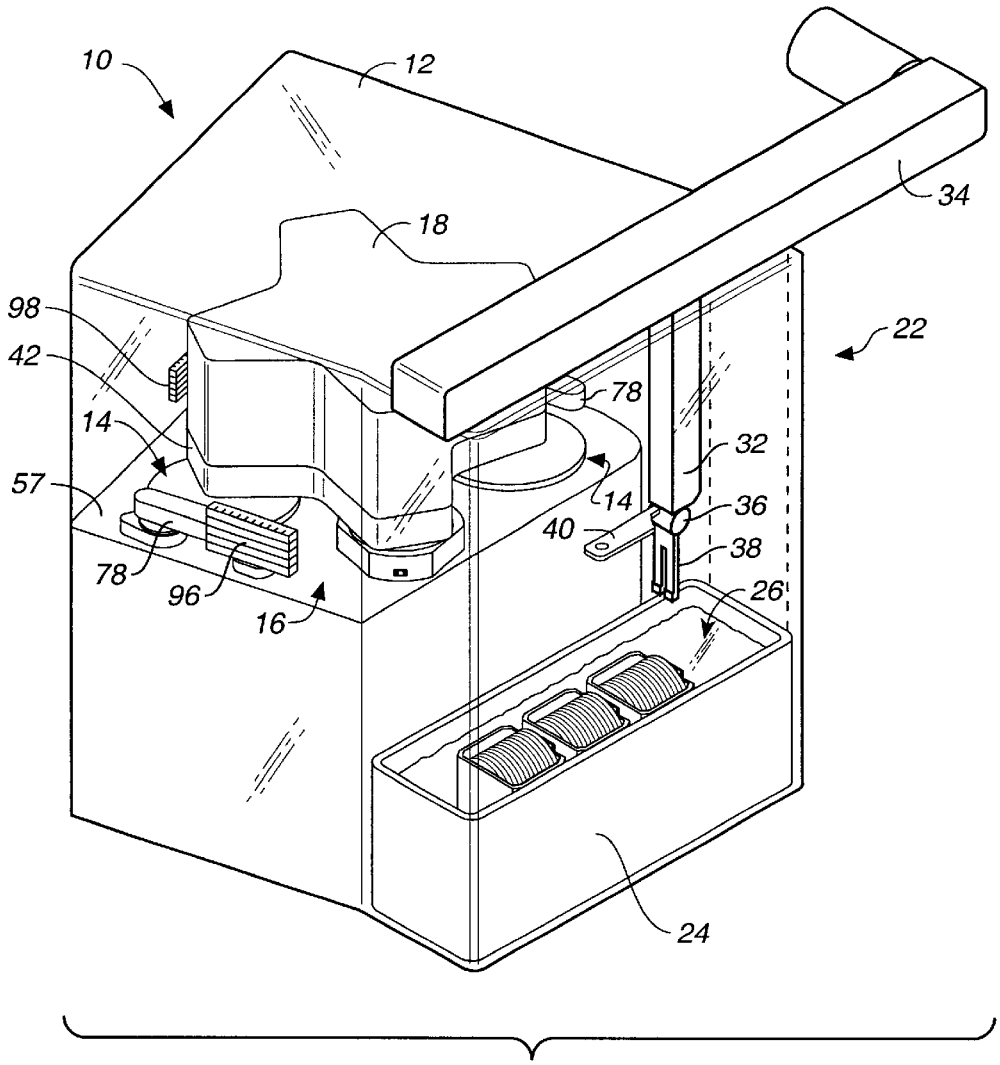
FIG. 1A is perspective view of a polishing apparatus.
Figure 1B:
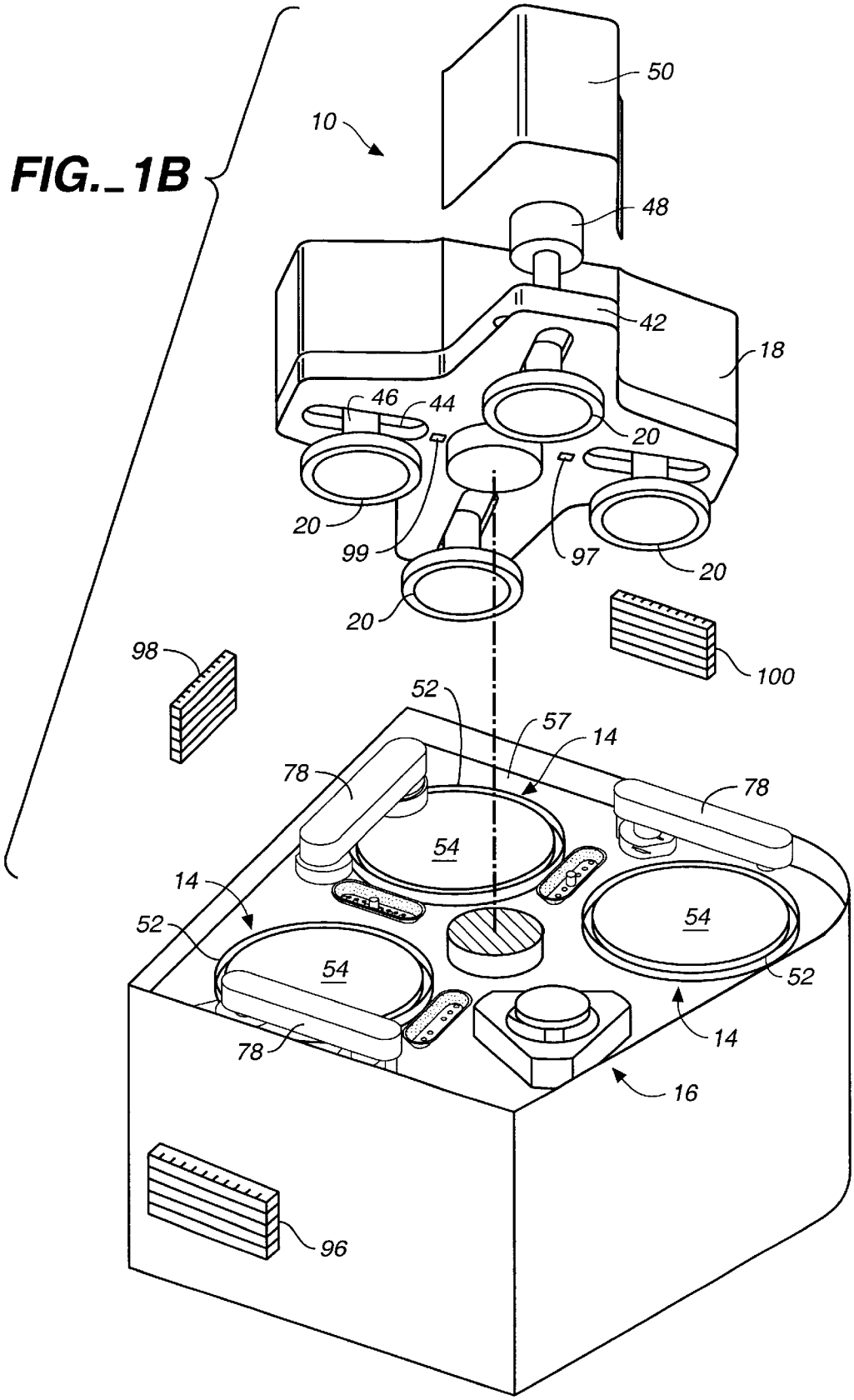
FIG. 1B is an exploded view of the polishing apparatus of FIG. 1A.

Referring to FIGS. 1A and 1B, a polishing apparatus 10 includes a housing 12 that defines a substantially enclosed polishing environment and contains three independently-operated polishing stations 14, a substrate transfer station 16, and a rotatable carousel 18 which choreographs the operation of four independently rotatable carrier heads 20. Attached to one side of housing 12 is a substrate loading apparatus 22 that includes a tub 24 that contains a liquid bath 26 in which cassettes 28 of substrates 30 are immersed before polishing.

Carousel 18 has a support plate 42 with slots 44 through which shafts 46 of carrier heads 20 extend. Carrier heads 20 can independently rotate and oscillate back-and-forth in slots 44 to achieve a uniformly polished substrate surface. Carrier heads 20 are rotated by respective motors 48, which are normally hidden behind removable sidewalls 50 of carousel 18. In operation, a substrate is loaded from tub 24 to transfer station 16, from which the substrate is transferred to a carrier head 20. Carousel 18 then transfers the substrate through a series of one or more polishing stations 14 and finally returns the polished substrate to transfer station 16.

Each polishing station 14 includes a rotatable platen 52, which supports a polishing pad 54, and a fluid delivery system 80. Platen 52 and fluid delivery system 78 are both mounted to a tabletop 57 of polishing apparatus 10. A pad conditioner (not shown) also may be provided to condition the surface of polishing pad 54.

For further details regarding the general features and operation of polishing apparatus 10, please refer to co-pending application Ser. No. 08/549,336, filed, Oct. 27, 1995, by Perlov et al., entitled "Continuous Processing System for Chemical Mechanical Polishing," and assigned to the assignee of the present invention, which is herein incorporated by reference.

Figure 2A:
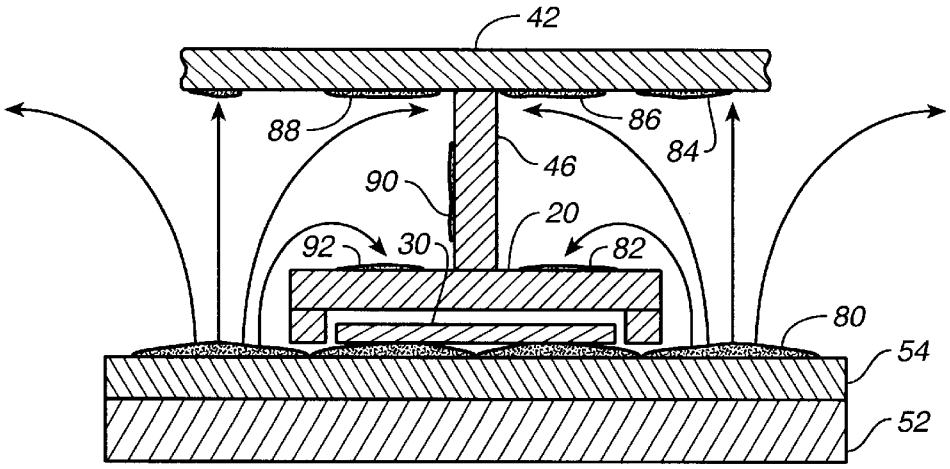
FIG. 2A is a diagrammatic side view of a substrate being polished and airborne slurry particles depositing onto exposed surfaces of the polishing apparatus.

Referring to FIG. 2A, substrate 30 is polished as it is pressed against and moved relative to polishing pad 54. Slurry particles in a colloidal suspension 80 assist in the polishing process. As substrate 30 is polished, portions of colloidal suspension 80 may evaporate or otherwise become airborne. This airborne substance may adhere to exposed surfaces in proximity to polishing pad 54. Once adhered to an exposed surface, the colloidal suspension tends to dry, leaving deposits 82, 84, 86, 88, 90 and 92 which may accumulate over time and occasionally flake off onto polishing pad 54. If such contamination becomes trapped between substrate 30 and polishing pad 54 while substrate 30 is being polished, it would likely cause a defect in the substrate surface.

Figure 2B:
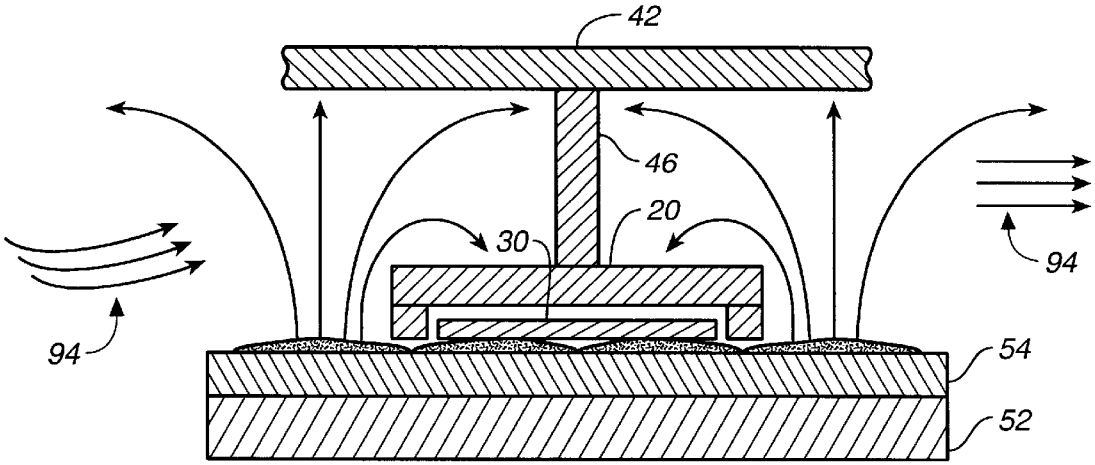
FIG. 2B is a diagrammatic side view of a substrate being polished while moist air is being directed to surfaces of the polishing apparatus in proximity to the polishing surface and exposed to airborne slurry particles generated during polishing.

As shown in FIG. 2B, this problem is substantially reduced by supplying moist air 94 to surfaces in proximity to polishing pad 54 and exposed to airborne slurry particles. Moist air 94 maintains the atmosphere in the vicinity of the exposed surfaces at a relative humidity level of about 80% or greater, and preferably at a relative humidity level of about 90% or greater, up to a relative humidity level of about 99%. At these humidity levels, colloidal suspensions adhering to the exposed surfaces do not dry and, instead, the slurry particles remain in suspension during polishing. In some modes of operation, moist air stream 94 maintains a layer of liquid (e.g., deionized water) on the exposed surfaces to prevent adhered colloidal suspensions from drying. Once a substrate has been polished the exposed surfaces may be rinsed with a flow of deionized water or other liquid that entrains the suspended slurry particles and washes them from the exposed surfaces. In this way, deposits of slurry particles do not accumulate on the exposed surfaces, reducing the amount of contamination that might cause substrate defects. The exposed surfaces may be rinsed after one or more substrates have been polished, or less often, e.g., while polishing pad 54 is being replaced or during some other routine maintenance procedure. One or more humidistats may be coupled to a controller in respective feedback loops to enable humidifiers 96–100 to maintain the atmosphere in the vicinity of the exposed surfaces at the desired humidity level.

Moist air stream 94 may be supplied to the exposed surfaces in proximity to polishing pad 54 in a variety of ways, including ultrasonic humidification and fine mist generation.

Referring back to FIGS. 1A and 1B, in one embodiment, three ultrasonic humidifiers 96, 98 and 100 are incorporated into three of the side walls of housing 12. Humidifiers 96–100 include air blowers that direct streams of air through respective atmospheres of atomized deionized water to generate moist air streams 94. Each humidifier 96–100 is configured to direct its moist air stream to a respective polishing station 14. The moist air streams preferably are directed in the vicinity of substrate carriers 20 and associated surfaces, including the surfaces of support plate 42 and slots 44, to prevent slurry deposits from accumulating on these surfaces. Humidifiers 96–100 may supply moist air streams to the exposed surfaces before, during and after substrate polishing. Humidistats 97, 99 and 101 (hidden) measure the relative humidity adjacent to exposed surfaces of support plate 42. Signals from humidistats 97, 99 and 101 are sent to a controller which controls the operation of humidifiers 96, 98 and 100 to achieve a desired relative humidity level in the vicinity of the exposed surfaces.

Figure 3:
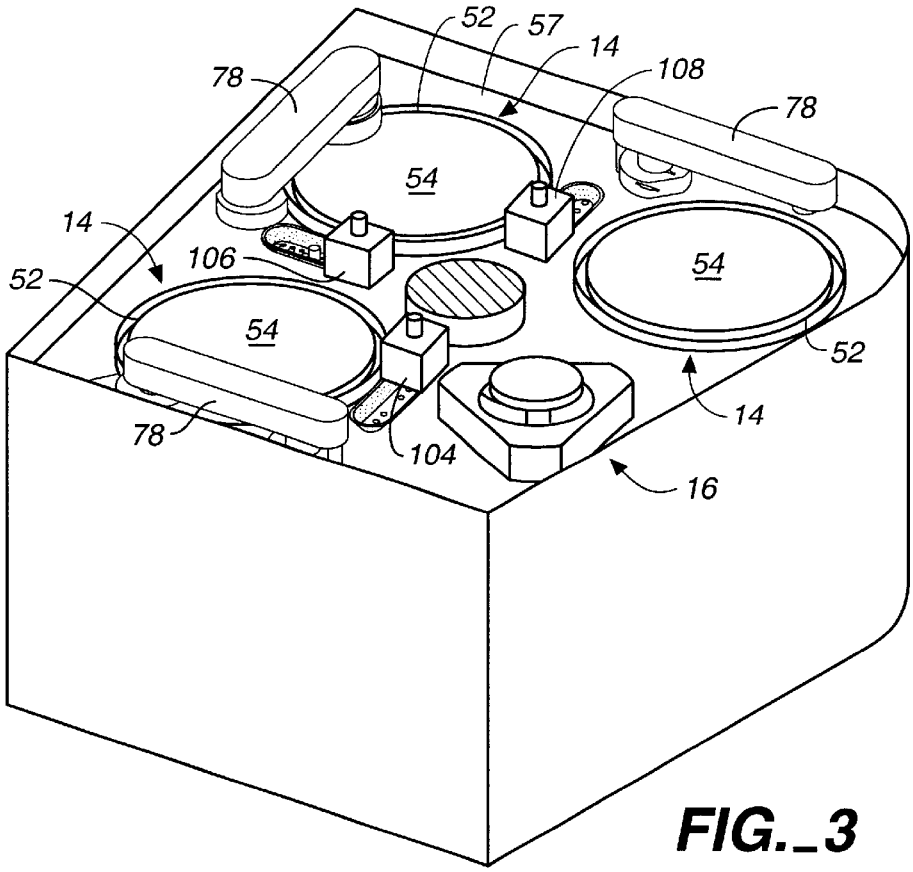
FIG. 3 is a diagrammatic view of the bottom portion of a substrate polishing apparatus that includes four misting nozzles.

Referring to FIG. 3, in another embodiment, polishing apparatus 10 includes four misting nozzles 102, 104 and 106, each positioned adjacent to a respective polishing station 14. Misting nozzles are configured to direct a fine water mist in the vicinity of surfaces in proximity to polishing pad 54 and exposed to airborne slurry particles generated during polishing. Each misting nozzle 102–106 directs its respective moist air stream in the vicinity of a respective substrate carrier 20 and its associated surfaces, including the associated surfaces of support plate 42 and slot 44, to prevent slurry deposits from accumulating on these surfaces. Misting nozzles 102–106 may be moved to other locations within polishing apparatus 10, or additional misting nozzles may be installed, to provide moisture sufficient to prevent slurries from drying on the exposed surfaces within the polishing apparatus.

Misting nozzles 102–106 are coupled to a controller (not shown) that is configured to choreograph the operation of nozzles 102–106. In one mode of operation, nozzles 102–106 supply moist air streams to the exposed surfaces only after a substrate has been polished, while the exposed surfaces are being cleaned (e.g., with a high pressure deionized water rinse), or before polishing while polishing apparatus 10 is idle. In another mode of operation, a humidistat is coupled to the controller in a feedback loop to enable misting nozzles 102–106 to maintain the atmosphere in the vicinity of the exposed surfaces at the desired relative humidity level. The controller is preferably programmable to enable operators to select the times during which nozzles 102–106 are supplying moist air streams 94 to the exposed surfaces.

Figure 4:
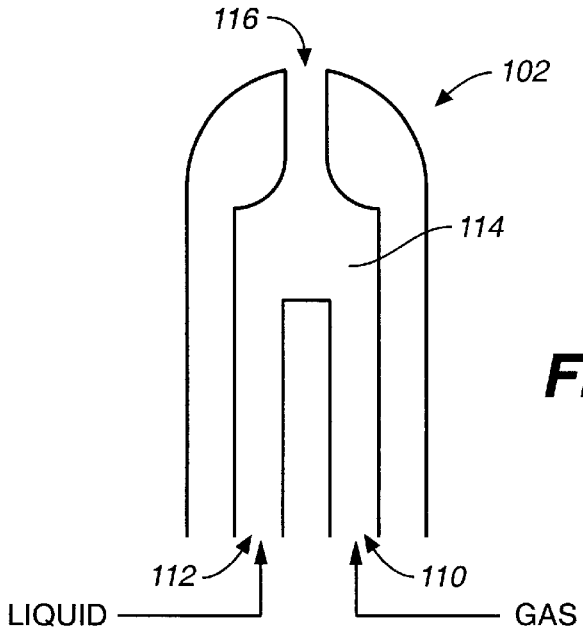
FIG. 4 is a cross-sectional side view of a misting nozzle.

As shown in FIG. 4, each misting nozzle 102–106 includes an inlet 110 for receiving a gas (e.g., nitrogen or "clean dry air"), an inlet 112 for receiving a liquid (e.g., deionized water), a mixing chamber 114, and an outlet 116 for supplying a fine mist of moist air to exposed surfaces of polishing apparatus 10. The pressures at which gas and liquid are supplied to nozzles 102–108 are selected to achieve a desired humidity level at the exposed surfaces. An exemplary gas pressure range is about 30–80 psi, and an exemplary liquid pressure range is about 25–55 psi.

Although a rotating polishing system has been described above, the invention also may be implemented in connection with a linear polishing system, such as the linear polishing system described in U.S. application Ser. No. 08/568,188, filed Dec. 5, 1995, and entitled "Substrate Belt Polisher," which is incorporated herein by reference.

Other embodiments are within the scope of the claims.

What is claimed is:

1. A substrate polishing system, comprising:

a polishing surface;

a substrate carrier to position a substrate in contact with the polishing surface;

a slurry dispenser; and a humidifier configured to direct moist air onto one or more surfaces of the substrate carrier that are in proximity to the polishing surface and exposed to airborne slurry particles generated during polishing.

2. The system of claim 1, wherein the humidifier comprises a liquid atomizer.

3. The system of claim 1, wherein the humidifier comprises a nozzle.

4. The system of claim 3, wherein the humidifier is configured to receive a liquid and a gas, to mix received liquid and gas, and direct the mixed liquid and gas through the nozzle to generate a fine mist in the vicinity of the one or more exposed surfaces.

5. The system of claim 1, wherein, in operation, the humidifier is configured to maintain the atmosphere in the vicinity of the one or more exposed surfaces at a relative humidity level of about 80% or greater.

6. The system of claim 1, wherein, in operation, the humidifier is configured to maintain a layer of liquid on the one or more exposed surfaces.

7. The system of claim 1, further comprising a humidistat coupled to the humidifier.

8. The system of claim 1, further comprising a base and a platen connected to the base to support the polishing surface.

9. The system of claim 8, wherein the humidifier includes one or more nozzles connected to the base.

10. The system of claim 9, wherein the one or more nozzles are positioned adjacent the polishing surface.

11. The system of claim 1, wherein the substrate carrier comprises a carrier head.

12. The system of claim 1, wherein the substrate carrier comprises a carousel and a carrier head suspended from the carousel, and the humidifier is configured to direct moist air onto one or more surfaces of the carousel.

* * * * *